US005117074A

United States Patent [19]

Yanai et al.

[11] Patent Number: 5,117,074

[45] Date of Patent: May 26, 1992

[54] WATERPROOF STRUCTURE FOR A SWITCH DEVICE

[75] Inventors: Shinji Yanai; Yujiro Shimoyama, both of Furukawa, Japan

[73] Assignee: Alps Electric Co., Ltd., Tokyo, Japan

[21] Appl. No.: 730,574

[22] Filed: Jul. 15, 1991

Related U.S. Application Data

[63] Continuation of Ser. No. 397,368, Aug. 22, 1989, abandoned, which is a continuation of Ser. No. 160,518, Feb. 26, 1988, abandoned.

[30] Foreign Application Priority Data

Dec. 5, 1987 [JP] Japan ..... 62-69599

[51] Int. Cl.[5] ..... H01H 9/04; H01H 19/06

[52] U.S. Cl. ..... 200/302.3; 200/302.1

[58] Field of Search ..... 200/306, 330, 292, 332, 200/302.3, 339, 553, 302.1

[56] References Cited

U.S. PATENT DOCUMENTS

| | | | |
|---|---|---|---|
| 3,586,810 | 6/1971 | Brown | 200/306 |
| 3,731,030 | 5/1973 | Holzer | 200/292 X |
| 4,340,791 | 7/1982 | Sorenson | 200/302 |
| 4,533,803 | 8/1985 | Beller et al. | 200/339 X |
| 4,803,317 | 2/1989 | Sutoh et al. | 200/438 |

FOREIGN PATENT DOCUMENTS

| | | | |
|---|---|---|---|
| 148123 | 5/1981 | Fed. Rep. of Germany | 200/306 |

*Primary Examiner*—Renee S. Luebke
*Assistant Examiner*—David J. Walczak
*Attorney, Agent, or Firm*—Guy W. Shoup; B. Noel Kivlin; Brian D. Ogonowsky

[57] ABSTRACT

A switch device which is operated by movement of a knob coupled to a switch actuator. The knob comprises a projection from a center of an arc-like skirt, wherein the arc-like skirt has a rounded slope extending from the projection to a periphery of the arc-like skirt. A cover arranged over a switch element mounted on a printed substrate defines an opening and has projection walls formed at peripheral edges of the opening, wherein the opening acts to receive the switch actuator, and wherein the arc-like skirt co-acts with the projection walls for preventing water from entering the opening. Liquid contacting the knob flows down the arc-like skirt and is drained through a drain passage formed in the cover. Thus, the switch device is essentially made waterproof by the co-action of the arc-like skirt, the projection walls, and the drain passage.

2 Claims, 2 Drawing Sheets

WATERPROOF STRUCTURE FOR A SWITCH DEVICE

This application is a continuation of application Ser. No. 397,368, filed Aug. 22, 1989, which is a continuation of Ser. No. 07/160,518, filed Feb. 26, 1988 now abandoned.

BACKGROUND OF THE INVENTION

1. Field of the Invention

This invention relates to a switch device and, more particularly, to a waterproof structure for a switch device.

2. Description of the Prior Art

Various types of switch devices are used depending upon a particular application. In certain applications, a switch device is frequently exposed to moisture, such as rain. One such application may be when the switch device is used in an automobile for controlling the position of an electrically powered seat. It would be desirable to enclose such a switch in a waterproof structure.

A variety of types of waterproof structures have been proposed for various types of switch devices. In a seesaw type switch, such as the type frequently used for controlling and lowering an electrically powered seat within an automobile, the prior art switches typically include a thin rubber sheet, through which a switch actuator for operating the switch is projected, for waterproofing the switch.

In the waterproof structure of the type described above, the rubber sheet is freely elastically deformed when the switch actuator is toggled. Thus, the rubber sheet prevents liquid from entering the upper surface of the switch housing into the interior of the switch. However, since the rubber sheet is made of a soft material, it is difficult to attach the sheet during manufacturing, and, as a result, certain fabrication steps must be performed manually. Additionally, since the elasticity of the rubber itself is limited, when a plurality of switches are mounted in the housing, sufficient waterproofing cannot be expected. Further, if liquid enters the switch housing through the rubber sheet, the liquid may cause an improper electrical contact of the switch.

SUMMARY OF THE INVENTION

Accordingly, it is an object of this invention to provide a switch device which eliminates the above-described drawbacks of the prior art and which can reliably prevent faulty electrical contact of the switch due to liquid entering the switch housing.

In order to achieve the above and other objects of the invention, there is provided according to the present invention a switch device having a switch actuator which may be swingably moved. The switch device is placed on a printed substrate. The switch actuator is operated by moving a knob attached to the switch actuator. A cover having an opening for the switch actuator is arranged on the printed substrate, wherein the opening has projection walls formed at peripheral edges thereof. The cover also includes a drain passage formed at a lower position of the projection walls for draining liquid to the exterior of the cover.

According to the present invention, the knob coupled to the switch actuator has a lower edge which overlaps the projection walls at the peripheral edges of the cover opening. The lower edge of the knob co-acts with the projection walls around the periphery of the opening so as to prevent water from entering the opening. Liquid which is prevented from entering the opening is drained to the exterior of the cover through the drain passage.

The above and other related objects and features of the invention will be apparent from a reading of the following description of the invention and the accompanying drawings and the novelty thereof identified in the appended claims.

DESCRIPTION OF THE PREFERRED EMBODIMENTS

Embodiments of a switch device according to the present invention will be described in detail with reference to the accompanying drawings.

Figure 1:
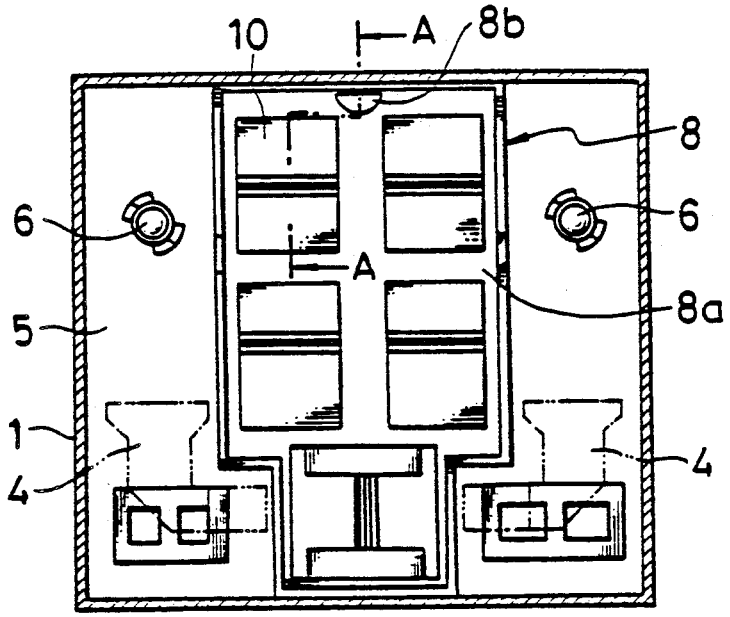
FIG. 1 is a plan view showing an embodiment of a switch device according to the present invention.
Figure 2:
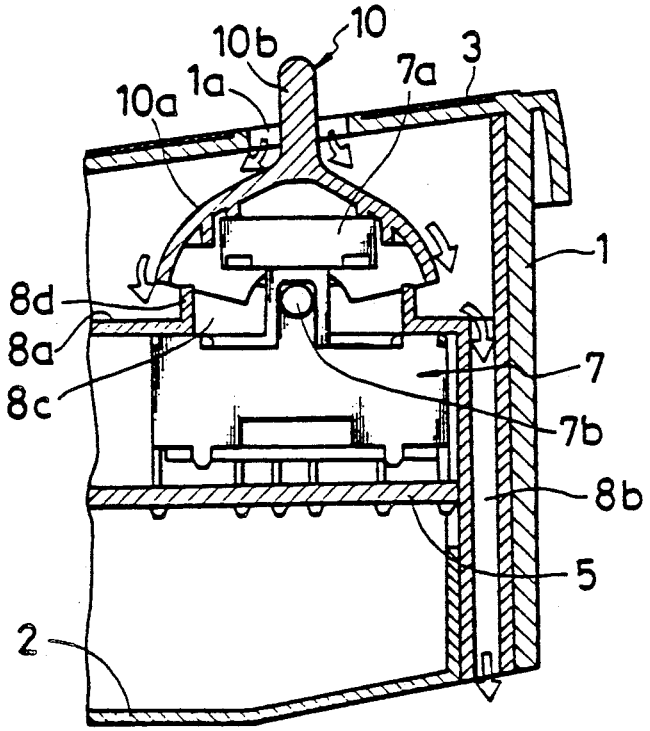
FIG. 2 is a side sectional view of an embodiment of the present invention taken along the line A—A of FIG. 1.
Figure 3:
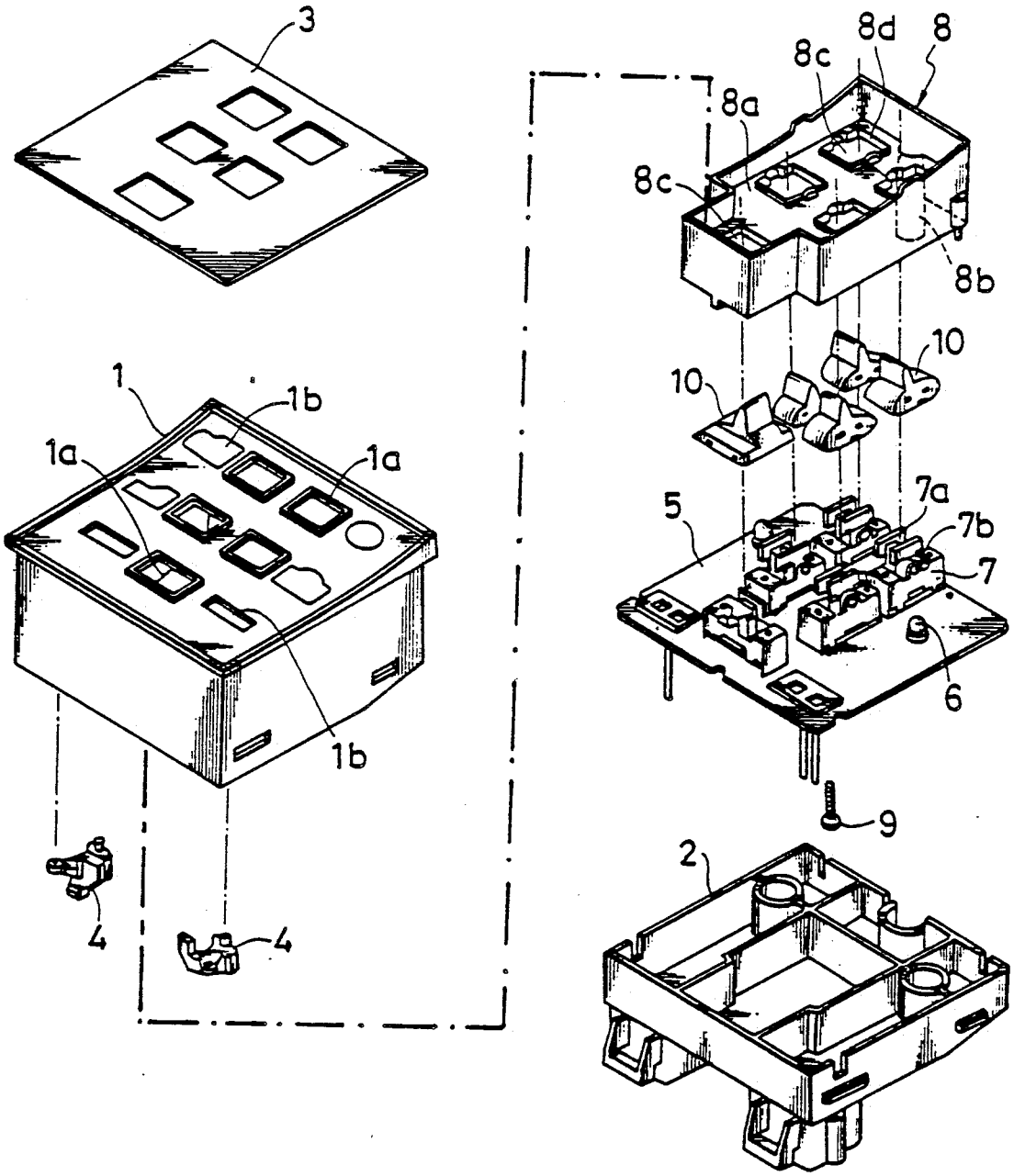
FIG. 3 is an exploded perspective view of the switch device of FIG. 1.

FIG. 1 is a plan view showing an embodiment of a switch device according to the present invention which has a portion of the case removed. FIG. 2 is a side sectional view of the embodiment taken along the line A—A of FIG. 1, and FIG. 3 is an exploded perspective view of the switch device.

In the drawings, reference numeral 1 designates an upper outer case made of a synthetic resin, and numeral 2 designates a lower outer case made of a synthetic resin. Both cases 1 and 2 are integrated by snap-coupling to form a complete outer case of the switch device. A display sheet 3 is bonded to the top surface of the upper outer case 1, and a light guide 4 for guiding the light of a light source, to be described later, is clamped by screws onto the surface opposing the top surface of the upper outer case 1. The top surface of the upper outer case 1 is perforated with a plurality of openings 1*a* corresponding to the placement of switch elements, to be described later, and perforated with a plurality of openings 1*b* corresponding to the display portions of the display sheet 3.

Reference numeral 5 designates a printed substrate, and reference numeral 6 designates a pair of light sources. A plurality (five in the embodiment shown in FIGS. 1 and 3) of switch elements 7 are placed on the printed substrate 5. The switch elements 7 are of a seesaw type which operate by swingably moving a conductor plate, not shown, by inclining the switch actuator 7*a* having a supporting shaft 7*b* as a fulcrum.

Reference numeral 8 designates a cover made of a synthetic resin. The cover 8 has a flat surface portion 8*a* and a semi-cylindrical drain passage 8*b* through surface 8*a*. A plurality of openings 8*c* are formed in surface 8*a* corresponding to the switch elements 7, and projecting walls 8*d* are formed around openings 8*c* so as to project upward.

The cover 8 thus constructed as described above is placed on the printed substrate 5 to cover the switch elements 7 and secured thereon with screws 9. In the illustration of FIG. 3, the switch actuators 7*a* of the switch elements 7 are projected upward and coincide with openings 8*c*. A plurality of knobs 10 made of synthetic resin are preferably snap-coupled to the upper end of each of switch actuators 7*a*. Each of knobs 10 have a circular arc-like skirt 10*a* having a projection 10*b* from a center of the arc-like skirt 10*a*. This projection 10*b*, when upper outer case 1 and lower outer case 2 are coupled together, protrudes through opening 1*a* of the upper outer case 1 to enable manual operation of an associated switch element 7. As shown in FIG. 2, skirt 10*a* has a lower peripheral edge which encloses the projection walls 8*d* of the cover 8, and thus the skirt 10*a* partially overlaps the projecting walls 8*d*.

In the switch device constructed as described above, a conductor plate, not shown, is operated by the switch actuator 7*a* to make or break an electrical contact when the knob 10 is inclined from a neutral position in FIG. 2, with the supporting shaft 7*b* as a fulcrum. Operation of such a switch may act to drive a motor, not shown, in a forward or reverse direction for operating an electrically operated seat in an automobile.

When liquid, such as water, is splashed on the switching device constructed as described above, the liquid flows as shown by arrows in FIG. 2 through opening 1*a* of the upper outer case 1 and along the skirt 10*a* into the interior of upper outer case 1. The liquid is prevented, however, from entering into the printed substrate portion of the switch by surface 8*a* of cover 8 and projecting walls 8*d*. The liquid entering upper outer case 1 and contacting surface 8*a* is drained from surface 8*a* via drain passage 8*b*. Thus, any liquid entering through opening 1*a* is prevented from further entering through opening 8*c* and interfering with the contact elements of the switch element 7.

The shape, number, and the arrangement of the drain passages 8*b* are not limited to the above-mentioned embodiment. These drain passages 8*b* may be modified in response to the application and the numbers of switch devices used.

According to the present invention as described above, the projecting walls 8*d* surrounding an opening 8*c*, and the drain passage 8*b* communicating with the exterior, are formed in the cover 8. As seen, as the knob 10 of the switch device comes in contact with liquid, the liquid is merely drained through the drain passage 8*b*, thereby providing a switch device being essentially waterproof without using a rubber seal, as described with respect to the prior art.

What is claimed is:

1. A switch device comprising a seesaw type switch element having a switch actuator, said switch element being mounted to a printed substrate;

a knob coupled to said switch actuator, said knob comprising a projection from a center of an arc-like skirt, said projection for being moved manually to operate said switch element, said arc-like skirt having a convex rounded slope extending from said projection to a periphery of said arc-like skirt wherein said projection and said convex rounded slope of said arc-like skirt are formed so as to cause liquid droplets coming into contact with any portion of said knob to run off said knob under the force of gravity when said projection is pointed in a direction generally away from said force of gravity;

a first cover arranged over said switch element, said first cover defining a first opening and having projection walls formed at peripheral edges of said first opening, said first opening for receiving said switch actuator, said arc-like skirt co-acting with said projection walls for preventing water from entering said first opening;

an upper cover enclosing said arc like skirt and said switch device and for defining an interior and an exterior of said switch device, and further defining a second opening for receiving said projection; and said first cover further defining a drain passage for draining liquid entering said interior through said second opening to said exterior of said switch device.

2. A switch device according to claim 1, wherein said first cover is secured to the printed substrate to cover the switch element.

* * * * *